US007744182B2

(12) United States Patent
Nakayama

(10) Patent No.: US 7,744,182 B2
(45) Date of Patent: Jun. 29, 2010

(54) CAPACITIVE LOAD DRIVING CIRCUIT AND METHOD, AND LIQUID DROP EJECTING DEVICE

(75) Inventor: Kota Nakayama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 280 days.

(21) Appl. No.: 11/438,170

(22) Filed: May 22, 2006

(65) Prior Publication Data

US 2007/0076026 A1 Apr. 5, 2007

(30) Foreign Application Priority Data

Oct. 5, 2005 (JP) ..... 2005-292536

(51) Int. Cl.
*B41J 2/045* (2006.01)

(52) U.S. Cl. ..... 347/10; 347/5; 347/11

(58) Field of Classification Search ..... 347/5, 347/9, 10, 11, 12, 94; 361/225
See application file for complete search history.

(56) References Cited

U.S. PATENT DOCUMENTS

| | | | | |
|---|---|---|---|---|
| 4,393,384 | A * | 7/1983 | Kyser | 347/94 |
| 6,504,701 | B1 * | 1/2003 | Takamura et al. | 361/225 |
| 2003/0234826 | A1 * | 12/2003 | Hosono et al. | 347/10 |
| 2006/0098036 | A1 * | 5/2006 | Gardner | 347/10 |

FOREIGN PATENT DOCUMENTS

| | | |
|---|---|---|
| JP | 5-138881 | 6/1993 |

* cited by examiner

*Primary Examiner*—Lam S Nguyen
(74) *Attorney, Agent, or Firm*—Fildes & Outland, P.C.

(57) ABSTRACT

A capacitive load driving circuit that supplies driving voltage to a capacitive load includes a driving voltage waveform generating unit. The driving voltage waveform generating unit, at times of charging or discharging of the capacitive load, generates a driving voltage waveform in which potential applied to the capacitive load varies stepwise from a first potential to a second potential during a predetermined time period.

12 Claims, 12 Drawing Sheets

FIG.5

| POINT | PIEZO CHARGING/DISCHARGING | AMOUNT OF GENERATED HEAT (J) OF DRIVER CIRCUIT | TIME CONSTANT ($\mu$S) |
|---|---|---|---|
| POINT 1 | DISCHARGING | $1/2C(HV1-HV2)^2$ | 1 |
| POINT 2 | DISCHARGING | $1/2CHV2^2$ | 1 |
| POINT 3 | CHARGING | $1/2CHV2^2$ | 1 |
| POINT 4 | CHARGING | $1/2C(HV1-HV2)^2$ | 1 |
| POINT 5 | DISCHARGING | $1/2C(HV1-HV2)^2$ | 1 |
| POINT 6 | DISCHARGING | $1/2CHV2^2$ | 1 |
| POINT 7 | CHARGING | $1/2CHV2^2$ | 1 |
| POINT 8 | CHARGING | $1/2C(HV1-HV2)^2$ | 1 |

FIG.9

| POINT | PIEZO CHARGING/DISCHARGING | AMOUNT OF GENERATED HEAT (J) OF DRIVER CIRCUIT | TIME CONSTANT ($\mu$S) |
|---|---|---|---|
| POINTS 1, 7 | DISCHARGING | $1/2C(HV1-HV2)^2$ | 0.67 |
| POINTS 2, 8 | DISCHARGING | $1/2C(HV2-HV3)^2$ | 0.67 |
| POINTS 3, 9 | DISCHARGING | $1/2CHV3^2$ | 0.67 |
| POINTS 4, 10 | CHARGING | $1/2CHV3^2$ | 0.67 |
| POINTS 5, 11 | CHARGING | $1/2C(HV2-HV3)^2$ | 0.67 |
| POINTS 6, 12 | CHARGING | $1/2C(HV1-HV2)^2$ | 0.67 |

FIG.12

| POINT | PIEZO CHARGING/DISCHARGING | AMOUNT OF GENERATED HEAT(J) OF DRIVER CIRCUIT | TIME CONSTANT(μS) |
|---|---|---|---|
| POINT 1 | DISCHARGING | $1/2CHV1^2$ | 2 |
| POINT 2 | CHARGING | $1/2CHV1^2$ | 2 |
| POINT 3 | DISCHARGING | $1/2CHV1^2$ | 2 |
| POINT 4 | CHARGING | $1/2CHV1^2$ | 2 |

CAPACITIVE LOAD DRIVING CIRCUIT AND METHOD, AND LIQUID DROP EJECTING DEVICE

CROSS-REFERENCE TO RELATED APPLICATION

This application claims priority under 35 USC 119 from Japanese Patent Application No. 2005-292536, the disclosure of which is incorporated by reference herein.

BACKGROUND OF THE INVENTION

1. Technical Field

The present invention relates to a capacitive load driving circuit and driving method and a liquid drop ejecting device, and in particular, to a capacitive load driving circuit and driving method and a liquid drop ejecting device in which the amount of generated heat can be suppressed.

2. Related Art

There has been proposed a liquid drop ejecting device which applies an electric signal to a recording head having a piezoelectric element, converts the electric signal into a pressure wave, and ejects a liquid drop due to the pressure wave. The piezoelectric element provided at the recording head of the liquid drop ejecting device has electrostatic capacity in the same way as a capacitor. Therefore, when a large number of piezoelectric elements are driven simultaneously, Joule heat is generated from the resistance, and heat energy is lost.

Thus, a method of driving a liquid jetting recording head has been known, in which the voltage pulse which is applied to a piezoelectric element is plural, continuous, rectangular pulses P1, P2, . . . Pn−1, Pn of a given peak value V1 in a predetermined time period T1, and at least some of the intervals of applying the pulses P1, P2, . . . Pn−1, Pn and/or the pulse widths are made to be different.

However, when the interval or the pulse width at which the voltage pulses are applied is changed, there is the concern that it may be difficult to form a highly-detailed image. Thus, the amount of generated heat must be suppressed without changing the interval or the pulse width at which the voltage pulses are applied.

FIG. 10 is a circuit diagram showing the structure of a conventional piezoelectric element driver circuit. FIG. 11 is a timing chart showing the on signal inputted to the conventional piezoelectric element driver circuit, and the output waveform. When the on signal is low level, a PMOS is on, and 20 (=HV1) V is applied to a piezoelectric element 40. On the other hand, when the on signal is high level, an NMOS is on and the piezoelectric element 40 is 0 V.

FIG. 12 is a diagram showing the amount of heat generated at each point in shown in FIG. 11. Note that the electrostatic capacity of the piezoelectric element 40 is C, and the time at each point, i.e., the time constant, is 2 μs. In this way, heat of $(½)C(HV1)^2$ [J] is generated in charging or discharging of one time. Accordingly, if an attempt is made to drive a large number of the piezoelectric elements 40 simultaneously, there is the problem that the amount of generated heat also increases in accordance therewith.

SUMMARY

The present invention is proposed in consideration of the above-described problems, and provides a capacitive load driving circuit and driving method and a liquid drop ejecting device which deal with suppressing the amount of heat generated at the time of driving a capacitive load.

A first aspect of the present invention is a capacitive load driving circuit supplying driving voltage to a capacitive load, the circuit having: a driving voltage waveform generating unit which, at times of charging or discharging of the capacitive load, generates a driving voltage waveform in which potential applied to the capacitive load varies stepwise from a first potential to a second potential during a predetermined time period.

A second aspect of the present invention is a capacitive load driving method supplying driving voltage to a capacitive load, the method including: at times of charging or discharging of the capacitive load, generating a driving voltage waveform in which potential of the capacitive load varies stepwise from a first potential to a second potential during a predetermined time period; and supplying the driving voltage waveform to the capacitive load.

A third aspect of the present invention is a liquid drop ejecting device having: a liquid drop ejecting head having a nozzle, a pressure generating chamber in which liquid drops to be ejected from the nozzle are filled, and a capacitive load provided in correspondence with the pressure generating chamber, the liquid drop ejecting head ejecting a liquid drop from the nozzle by applying voltage corresponding to a driving signal to the capacitive load and changing a volume of the pressure generating chamber; and a capacitive load driving circuit supplying driving voltage to the capacitive load, and having a driving voltage waveform generating unit which, at times of charging or discharging of the capacitive load, generates a driving voltage waveform in which potential applied to the capacitive load varies stepwise from a first potential to a second potential during a predetermined time period.

BRIEF DESCRIPTION OF THE DRAWINGS

Embodiments of the present invention will be described in detail based on the following figures, wherein:

FIG. 5 is a diagram showing an amount of generated heat at each point shown in FIG. 4;

FIG. 9 is a diagram showing an amount of generated heat at each point shown in FIG. 8;

FIG. 12 is a diagram showing an amount of generated heat at each point shown in FIG. 11.

DETAILED DESCRIPTION

Preferred embodiments of the present invention will be described in detail hereinafter with reference to the drawings.

First Embodiment

Figure 1:
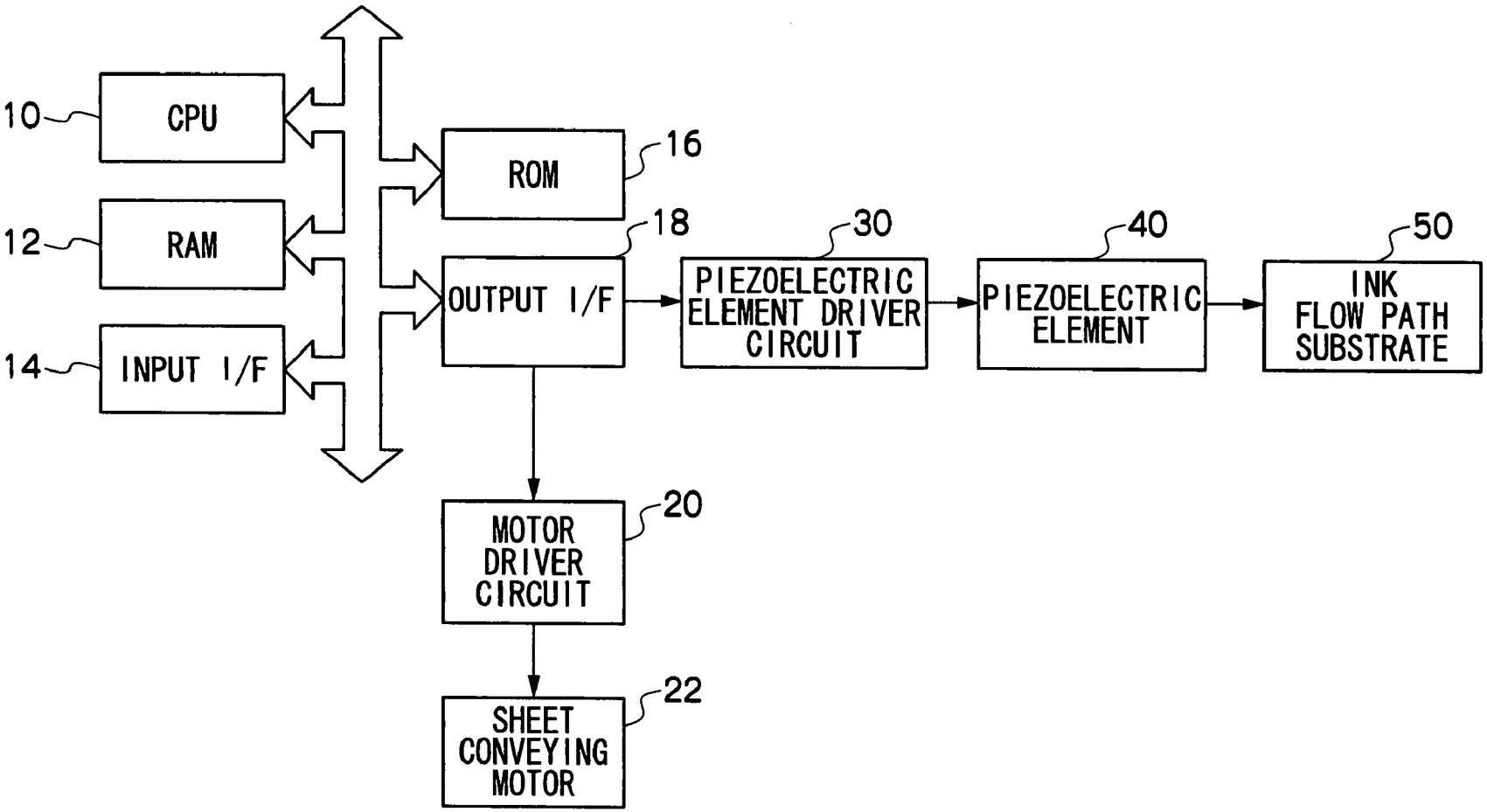
FIG. 1 is a block diagram showing the structure of a liquid drop ejecting device relating to a first embodiment of the present invention.

FIG. 1 is a block diagram showing the structure of a liquid drop ejecting device relating to a first embodiment of the present invention. The liquid drop ejecting device has a CPU 10 carrying out overall control of the present device, a RAM 12 which is a work area for data, an input interface 14 to which data is inputted from the exterior, a ROM 16 in which programs of the CPU 10 are stored, and an output interface 18 outputting data.

The liquid drop ejecting device further has a motor driver circuit 20 driving a sheet conveying motor 22, which will be described hereinafter, on the basis of the control of the CPU 10, the sheet conveying motor 22 for conveying a recording sheet in a predetermined direction, a piezoelectric element driver circuit 30 driving a piezoelectric element 40, which will be described hereinafter, on the basis of the control of the CPU 10, the piezoelectric element 40 which vibrates due to the piezoelectric element driver circuit 30, and an ink flow path substrate 50 ejecting ink due to the vibration of the piezoelectric element 40. Note that a recording head includes the piezoelectric element driver circuit 30, the piezoelectric element 40, and the ink flow path substrate 50. Further, in the present embodiment, an example will be described in which ink is used as the liquid drops which are ejected, but the liquid drops are of course not limited to ink.

Figure 2:
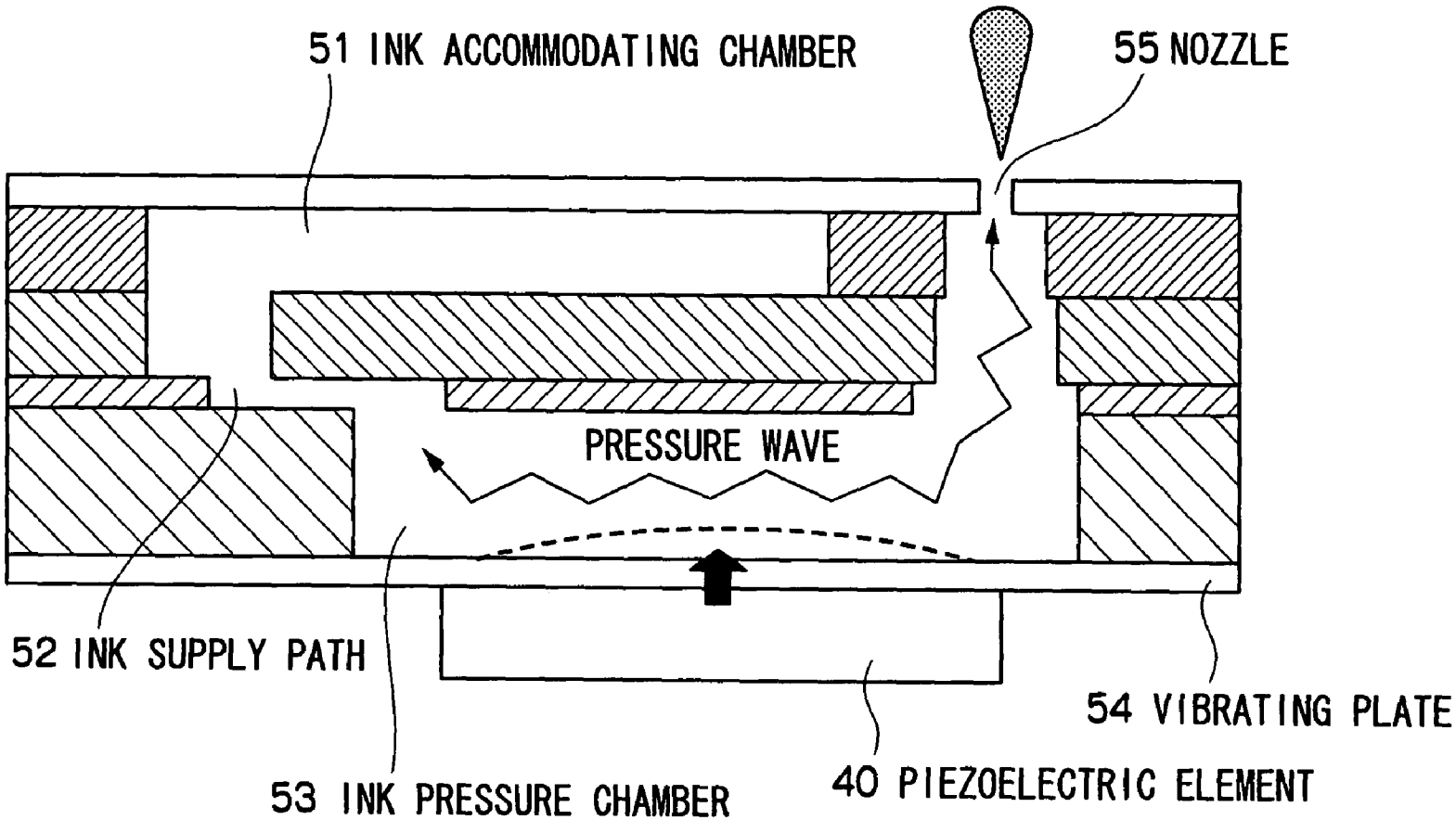
FIG. 2 is a cross-sectional view showing the structure of an ink flow path substrate 50.

FIG. 2 is a cross-sectional view showing the structure of the ink flow path substrate 50. The ink flow path substrate 50 has an ink accommodating chamber 51 which accommodates in advance ink which is to be ejected, an ink pressure chamber 53 which is a place which applies pressure to ink supplied from the ink accommodating chamber 51 via an ink supply path 52, a vibrating plate 54 vibrating in accordance with deformation of the piezoelectric element 40 and applying pressure to the ink, and a nozzle 55 which is the exit for the ink to which pressure is applied.

Ink is supplied to the ink pressure chamber 53 from the ink accommodating chamber 51 via the ink supply path 52. One side of the vibrating plate 54 contacts the ink pressure chamber 53, whereas the other side contacts the piezoelectric element 40. When driving voltage is supplied to the piezoelectric element 40, the piezoelectric element 40 deforms. When the piezoelectric element 40 deforms, the internal pressure within the ink pressure chamber 53 rises via the vibrating plate 54, and ink is ejected from the nozzle 55.

Figure 3:
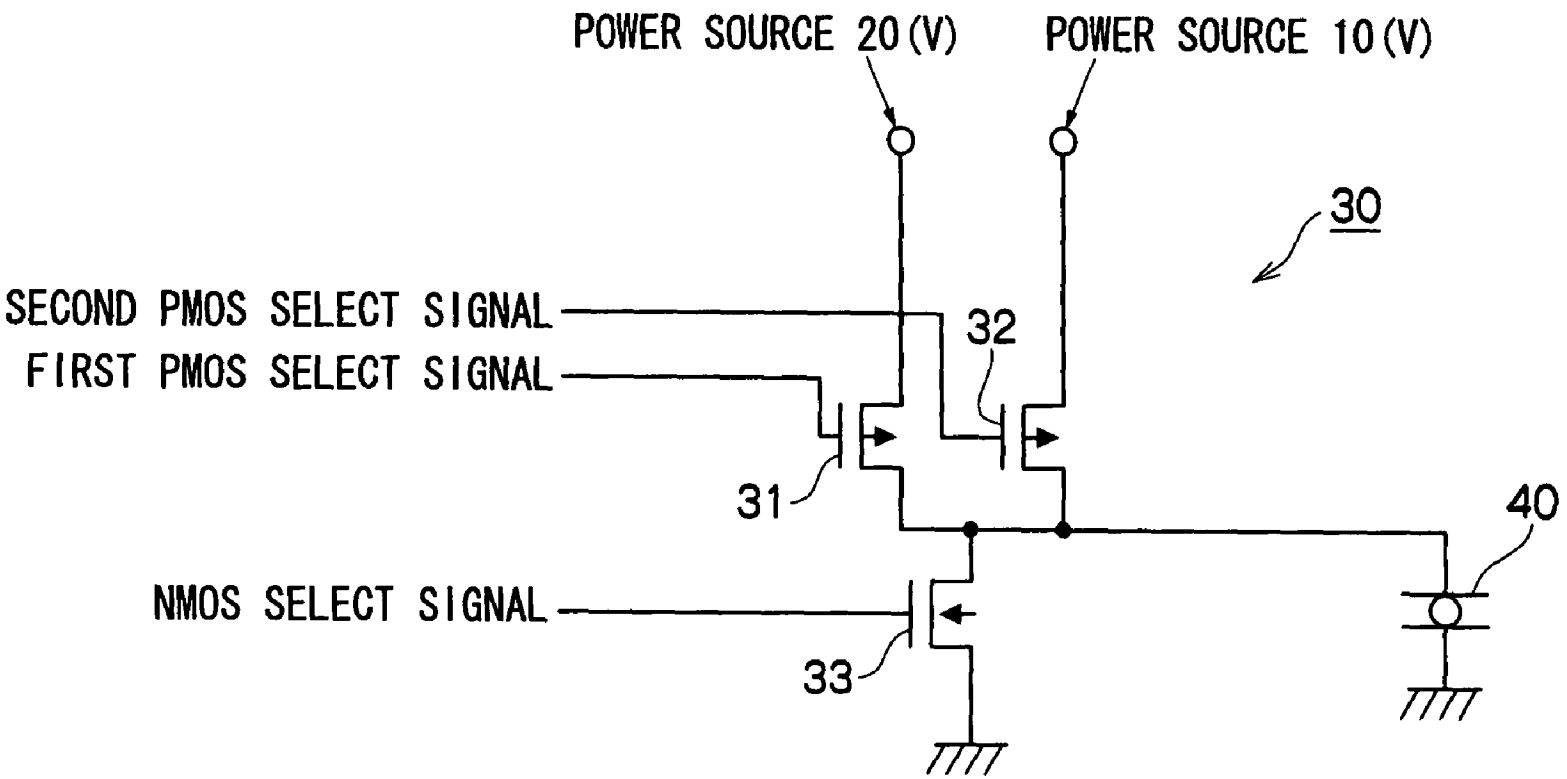
FIG. 3 is a circuit diagram showing the structure of a piezoelectric element driver circuit 30.

FIG. 3 is a circuit diagram showing the structure of the piezoelectric element driver circuit 30. The piezoelectric element driver circuit 30 has first and second PMOS transistors 31, 32 which are P-channel MOSFETs, and an NMOS transistor 33 which is an N-channel MOSFET. Note that the on resistance of each of the first and second PMOS transistors 31, 32 and the NMOS transistor 33 is 1 kΩ, and an electrostatic capacity C of the piezoelectric element 40 is 500 pF.

Voltage of 20 [V] (=HV1 [V]) is supplied from a constant voltage source (not shown) to the source of the first PMOS transistor 31. Voltage of 10 [V] (=HV2 [V]) is supplied from a constant voltage source (not shown) to the source of the second PMOS transistor 32.

The drains of the first PMOS transistor 31 and the second PMOS transistor 32 are both connected to the drain of the NMOS transistor 33 and to one plate of the piezoelectric element 40 respectively. The source of the NMOS transistor 33 and the other electrode of the piezoelectric element 40 are grounded.

First and second PMOS select signals and an NMOS select signal are supplied to the respective gates of the first and second PMOS transistors 31, 32 and the gate of the NMOS transistor 33, respectively. When the first PMOS transistor 31 is turned on, the applied voltage of the piezoelectric element 40 is made to be 20 V. When the second PMOS transistor 32 is turned on, this applied voltage is made to be 10 V. When the NMOS transistor 33 is turned on, this applied voltage is made to be zero.

The piezoelectric element driver circuit 30, which is structured as described above, supplies driving voltage to the piezoelectric element 40 as follows.

Figure 4:
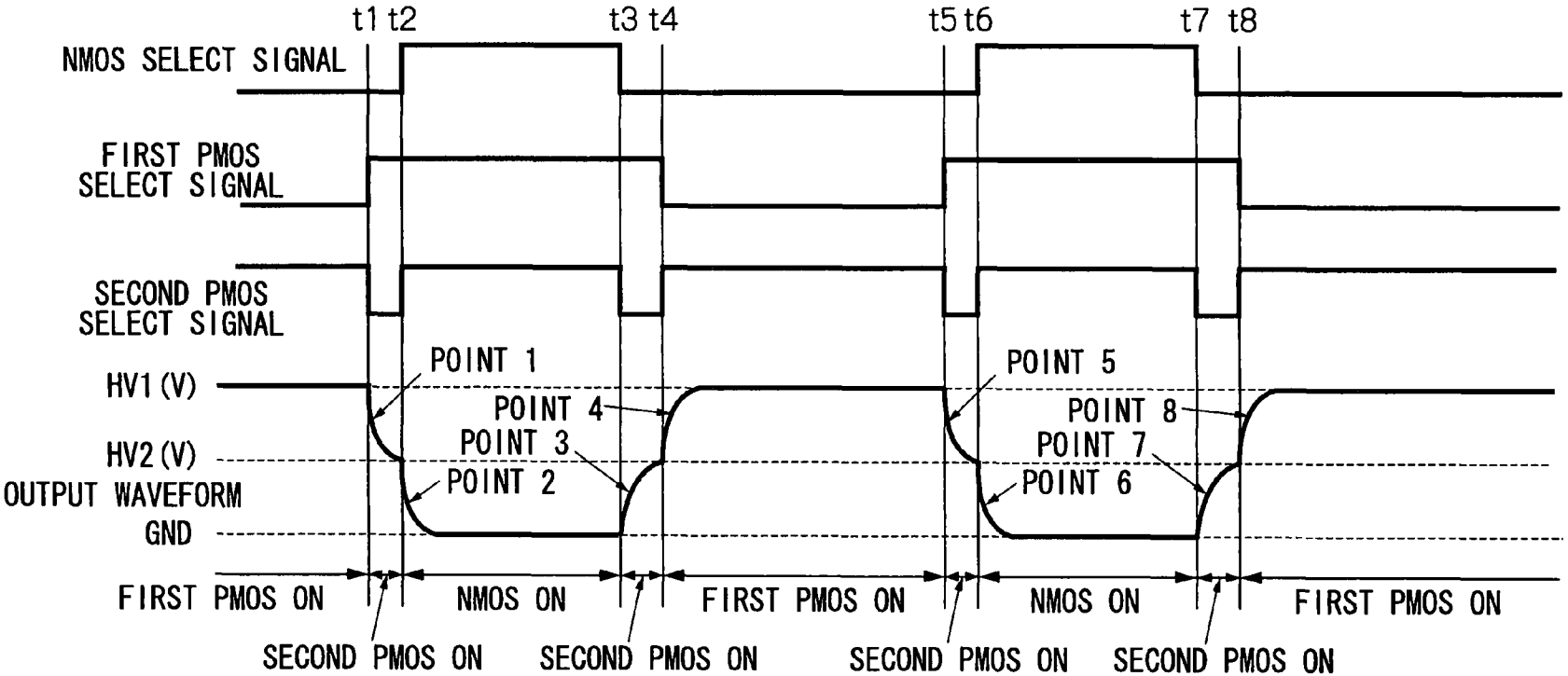
FIG. 4 is a timing chart of a first PMOS select signal, a second PMOS select signal, and an NMOS select signal.

FIG. 4 is a timing chart of the first PMOS select signal, the second PMOS select signal, and the NMOS select signal.

From time zero to time t1, both the NMOS select signal and the first PMOS select signal are low level, but the second PMOS select signal is high level. Therefore, only the first PMOS transistor 31 is on, and the second PMOS transistor 32 and the NMOS transistor 33 are off. Accordingly, the voltage of the piezoelectric element 40 is 20 [V]. Note that the time constant of the first PMOS transistor 31 is 1 μs.

From time t1 to t2, the NMOS select signal is low level, the first PMOS select signal is high level, and the second PMOS select signal is low level. Accordingly, only the second PMOS transistor 32 is on. Note that the time constant of the second PMOS transistor 32 is 1 μs. Accordingly, at the transient period of point 1, the voltage of the piezoelectric element 40 changes from 20 to 10 [V].

From time t2 to t3, the first and second PMOS select signals and the NMOS signal are all high level. Therefore, only the NMOS transistor 33 is on. Note that the time constant of the NMOS transistor 33 is 1 μs. Accordingly, at the transient period of point 2, the voltage of the piezoelectric element 40 changes from 10 to 0 [V].

From time t3 to t4, the NMOS select signal is low level, the first PMOS select signal is high level, and the second PMOS select signal is low level. Therefore, only the second PMOS transistor 32 is on. Accordingly, at the transient period of point 3, the voltage of the piezoelectric element 40 changes from 0 to 10 [V].

From time t4 to time t5, the NMOS select signal and the first PMOS select signal are both low level, and the second PMOS select signal is high level. Therefore, only the first PMOS transistor 31 is on. Accordingly, at the transient period of point 4, the voltage of the piezoelectric element 40 changes from 10 to 20 [V].

Note that the transient periods at the time of charging and at the time of discharging are the same as the transient periods at the time of conventional charging and discharging. Further, the states between the respective times of t5, 56, t7, t8 are the same as the above-described states between the times of t1, t2, t3, t4. Accordingly, points 5, 6, 7, 8 shown in FIG. 4 are the same as the above-described points 1, 2, 3, 4.

FIG. 5 is a diagram showing the amount of heat generated at each point shown in FIG. 4. Here, the electrostatic capacity of the piezoelectric element 40 is C.

At the transient periods of points 1 and 5, the piezoelectric element 40 discharges, and the amount of generated heat of the piezoelectric element driver circuit 30 is $(1/2)\cdot C\cdot(HV1-HV2)^2$ [J]. The time constant at this time is 1 μs.

At the transient periods of points 2 and 6, the piezoelectric element 40 discharges, and the amount of generated heat of the piezoelectric element driver circuit 30 is $(1/2)\cdot C\cdot(HV2)^2$ [J]. The time constant at this time is 1 μs.

At the transient periods of points 3 and 7, the piezoelectric element 40 charges, and the amount of generated heat of the piezoelectric element driver circuit 30 is $(1/2)\cdot C\cdot(HV2)^2$ [J]. The time constant at this time is 1 μs.

At the transient periods of points 4 and 8, the piezoelectric element 40 charges, and the amount of generated heat of the piezoelectric element driver circuit 30 is $(1/2)\cdot C\cdot(HV1-HV2)^2$ [J]. The time constant at this time is 1 μs.

Accordingly, considering that HV1=(½)HV2, the total amount of generated heat of the piezoelectric element driver circuit 30 (two times discharging and two times charging) is $$2C\cdot(HV2)^2+2C\cdot(HV1-HV2)^2=C\cdot(HV1)^2[J].$$

In contrast, as shown in FIG. 12, when the piezoelectric element 40 is charged one time all at once from 0 to 20 (=HV1) [V], or is discharged one time all at once from 20 to 0 [V], the amount of generated heat of the piezoelectric element driver circuit 30 is $(1/2)\cdot C\cdot(HV1)^2$ [J]. Accordingly, the total amount of generated heat of discharging two times and charging two times by the conventional piezoelectric element driver circuit is $2C\cdot(HV1)^2$ [J], which is twice that of the present embodiment.

As described above, in the liquid drop ejecting device relating to the first embodiment of the present invention, at the time of charging the piezoelectric element 40, the driving voltage of the piezoelectric element 40 is not controlled all at once from ground level to high level HV1, but is controlled from ground level through intermediate level HV2 to high level HV1. Therefore, the liquid drop ejecting device can make the amount of heat generated due to the charging of the piezoelectric element 40 be half of that of the conventional art. Further, by controlling the voltage similarly at the time of discharging the piezoelectric element 40 as well, the liquid drop ejecting device can halve the amount of heat generated due to the discharging of the piezoelectric element 40.

Figure 6:
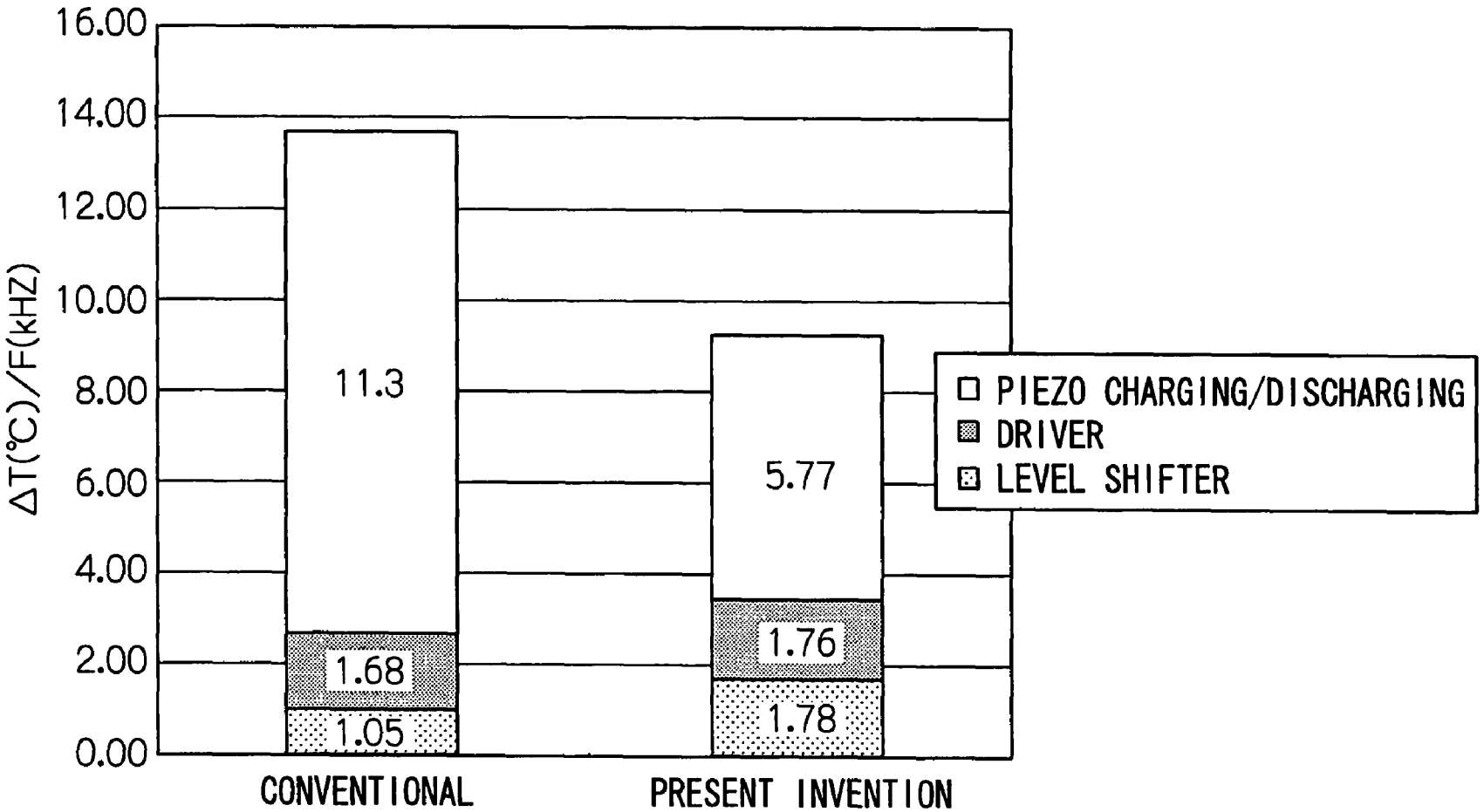
FIG. 6 is a diagram showing measured values of amounts of generated heat of a conventional driver circuit and the piezoelectric element driver circuit 30 of the present invention.

FIG. 6 is a diagram showing measured values of the generated heat amounts of a conventional driver circuit and the piezoelectric element driver circuit 30 of the present invention. Note that "driver" and "level shifter" in FIG. 6 are circuit sections within the IC. In this way, in the driver circuit of the present invention, the generation of heat due to "piezo charging/discharging" is about half of that of the conventional driver circuit.

As a result, the liquid drop ejecting device can lower the driving energy of the recording head and can suppress the generation of heat of the piezoelectric element driver circuit 30 which is an IC for driving. Therefore, costs required for cooling the IC for driving also can be reduced.

Second Embodiment

A second embodiment of the present invention will be described next. A liquid drop ejecting device relating to the second embodiment is structured substantially similarly to that of the first embodiment, but has a piezoelectric element driver circuit 30A of a different structure than the piezoelectric element driver circuit 30.

Figure 7:
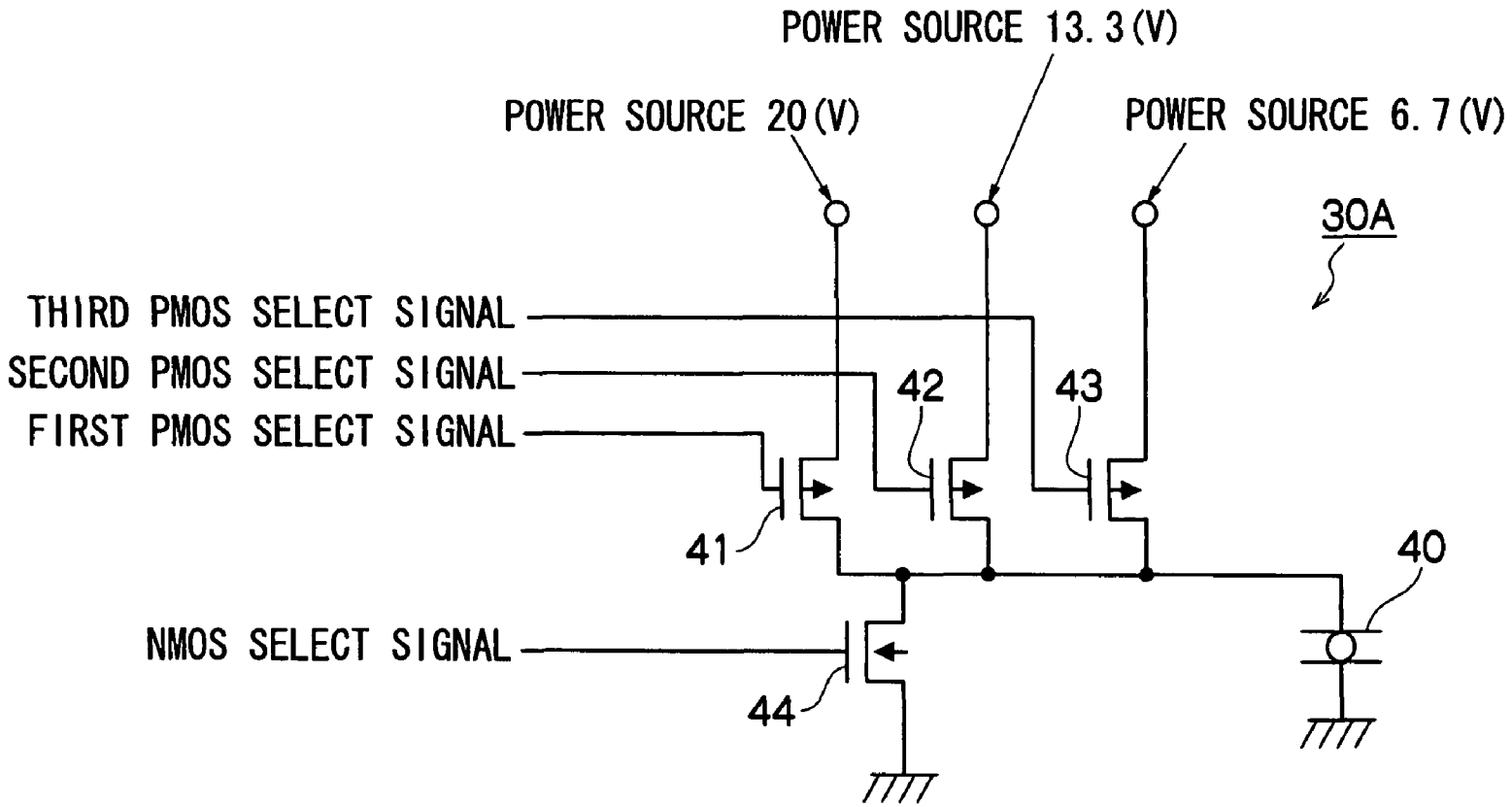
FIG. 7 is a circuit diagram showing the structure of a piezoelectric element driver circuit 30A relating to a second embodiment of the present invention.

FIG. 7 is a circuit diagram showing the structure of the piezoelectric element driver circuit 30A. The piezoelectric element driver circuit 30A has first through third PMOS transistors 41, 42, 43 which are P-channel MOSFETs, and an NMOS transistor 44 which is an N-channel MOSFET. Note that the on resistance of each of the first through third PMOS transistors 41, 42, 43 and the NMOS transistor 44 is 1 kΩ.

Voltage of 20 [V] (=HV1 [V]) is supplied from a constant voltage source (not shown) to the source of the first PMOS transistor 41. Voltage of 13.3 [V] (=HV2 [V]) is supplied from a constant voltage source (not shown) to the source of the second PMOS transistor 42. Voltage of 6.7 [V] (=HV3 [V]) is supplied from a constant voltage source (not shown) to the source of the third PMOS transistor 43.

The drains of the first through third PMOS transistors 41, 42, 43 are respectively connected to the drain of the NMOS transistor 44 and to one plate of the piezoelectric element 40. The source of the NMOS transistor 44 and the other electrode of the piezoelectric element 40 are grounded.

First through third PMOS select signals and an NMOS select signal are supplied to the gates of the first through third PMOS transistors 41, 42, 43 and the gate of the NMOS transistor 44, respectively.

When the first PMOS transistor 41 is turned on, the applied voltage of the piezoelectric element 40 becomes 20 V. When the second PMOS transistor 42 is turned on, the applied voltage becomes 13.3 V. When the third PMOS transistor 43 is turned on, the applied voltage becomes 6.7 V. When the NMOS transistor 44 is turned on, the applied voltage becomes zero.

The piezoelectric element driver circuit 30A, which is structured as described above, supplies driving voltage to the piezoelectric element 40 as follows.

Figure 8:
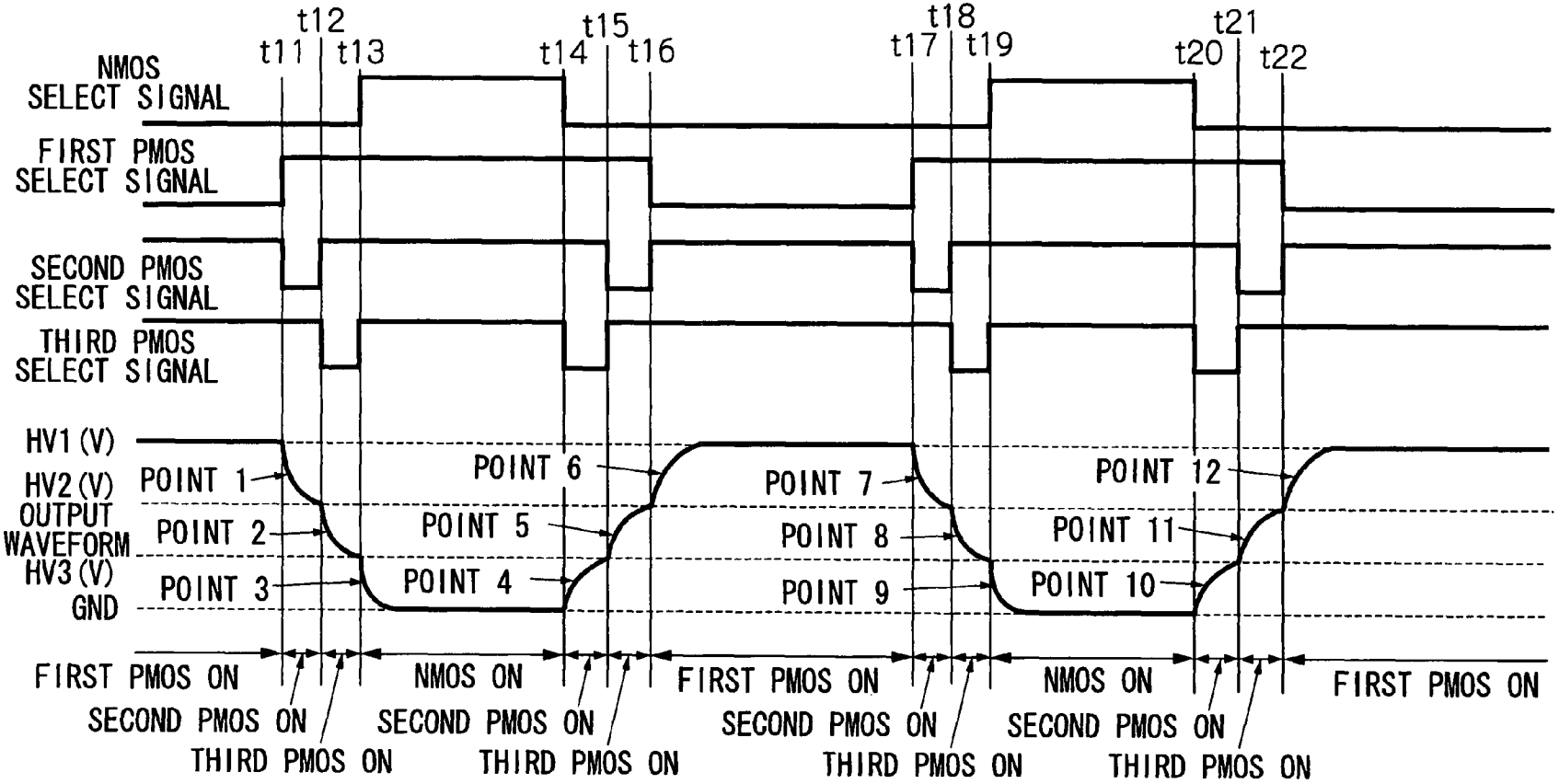
FIG. 8 is a timing chart of first through third PMOS select signals and an NMOS select signal.
Figure 10:
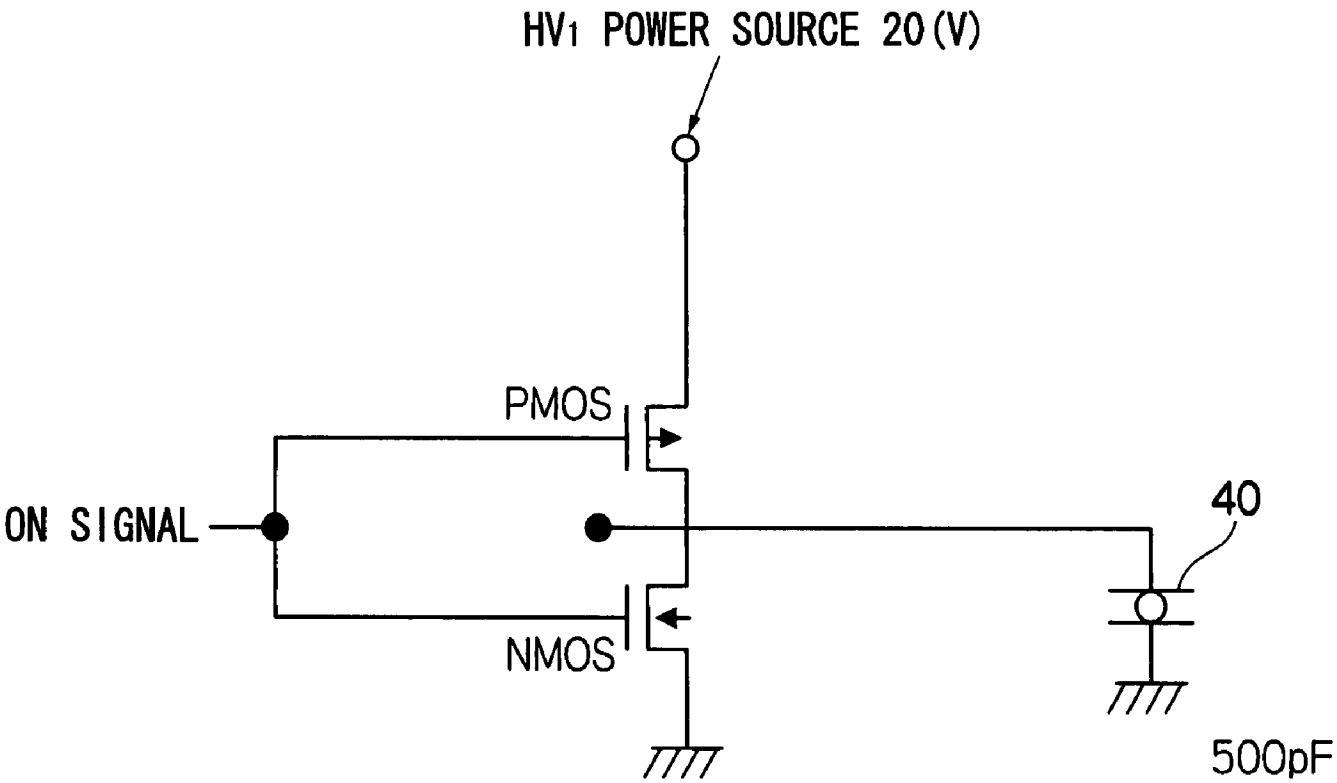
FIG. 10 is a circuit diagram showing the structure of a conventional piezoelectric element driver circuit.
Figure 11:
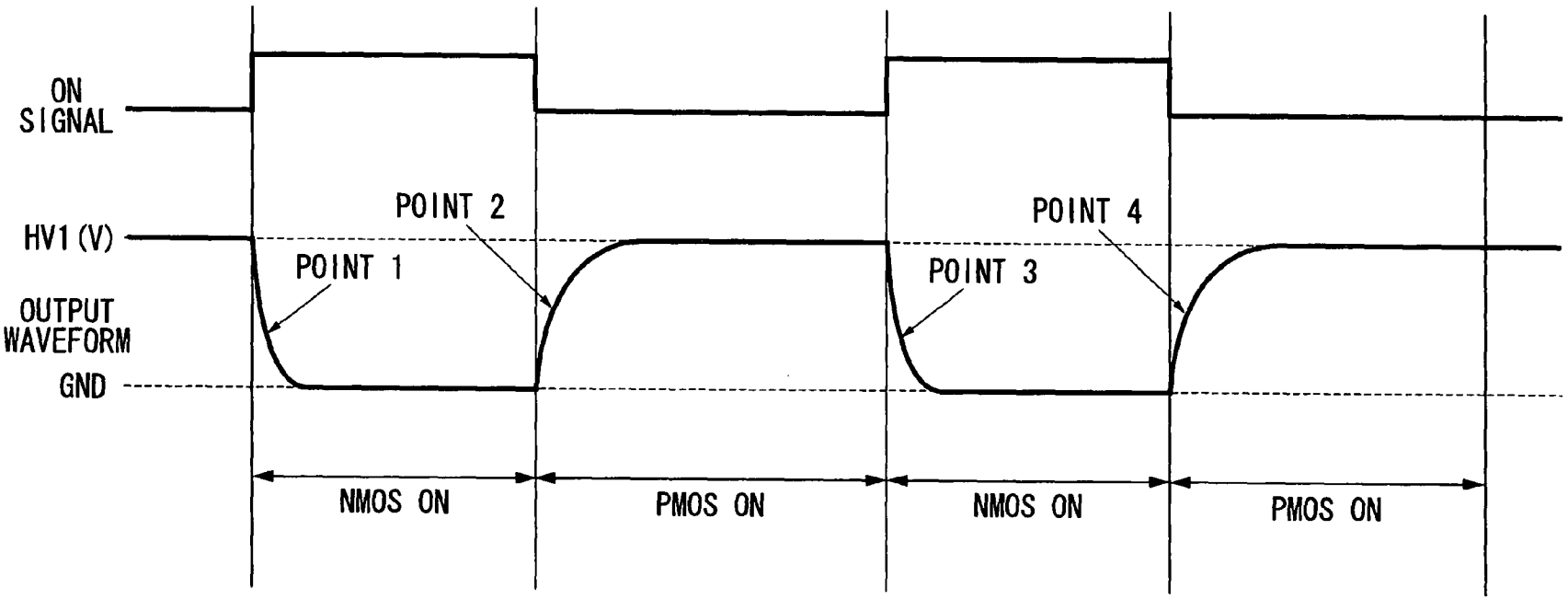
FIG. 11 is a timing chart showing an on signal inputted to the conventional piezoelectric element driver circuit, and an output waveform.

FIG. 8 is a timing chart of the first through third PMOS select signals and the NMOS select signal. Note that description will mainly be given of the time of charging the piezoelectric element 40 (points 1 through 3), but the same holds for the time of discharging (points 4 through 6).

From time zero to time t11, only the first PMOS transistor 41 is on. Accordingly, the voltage of the piezoelectric element 40 is 20 [V]. Note that the time constant of the first PMOS transistor 41 is 0.67 μs.

From time t11 to t12, only the second PMOS transistor 42 is on. Accordingly, at the transient period of point 1, the voltage of the piezoelectric element 40 changes from 20 to 13.3 [V]. Note that the time constant of the second PMOS transistor 42 is 0.67 μs.

From time t12 to t13, only the third PMOS transistor 43 is on. Accordingly, at the transient period of point 2, the voltage of the piezoelectric element 40 changes from 13.3 to 6.7 [V]. Note that the time constant of the third PMOS transistor 43 is 0.67 μs.

From time t13 to t14, only the NMOS transistor 44 is on. Accordingly, at the transient period of point 3, the voltage of the piezoelectric element 40 changes from 6.7 to 0 [V]. Note that the time constant of the NMOS transistor 44 is 0.67 μs.

FIG. 9 is a diagram showing the amount of heat generated at each point shown in FIG. 8. Here, the electrostatic capacity of the piezoelectric element 40 is C.

At the transient periods of points 1 and 7, the piezoelectric element 40 discharges, and the amount of generated heat of the piezoelectric element driver circuit 30 is $(1/2)\cdot C\cdot(HV1-HV2)^2$ [J]. The time constant at this time is 0.67 μs.

At the transient periods of points 2 and 8, the piezoelectric element 40 discharges, and the amount of generated heat of the piezoelectric element driver circuit 30 is $(1/2)\cdot C\cdot(HV2-HV3)^2$ [J]. The time constant at this time is 0.67 μs.

At the transient periods of points 3 and 9, the piezoelectric element 40 discharges, and the amount of generated heat of the piezoelectric element driver circuit 30 is $(1/2)\cdot C\cdot(HV3)^2$ [J]. The time constant at this time is 0.67 μs.

At the respective transient periods of points 4 through 6 and 10 through 12, the piezoelectric element 40 charges, and the amounts of generated heat are values similar to those at the time of discharging. Note that the transient periods at the time of charging and at the time of discharging are the same as the transient periods at the time of conventional charging and discharging.

Accordingly, considering that HV2=(⅔)HV1 and HV3=(⅓)HV1, the total amount of generated heat of the piezoelectric element driver circuit 30 (two times discharging and two times charging) is $$2C\cdot(HV3)^2+2C\cdot(HV2-HV3)^2+2C(\cdot HV1-HV2)^2=(2/3)\cdot C\cdot(HV1)^2\ [J].$$

In contrast, as described above, the total amount of generated heat of discharging two times and charging two times by the conventional piezoelectric element driver circuit is $2C\cdot(HV1)^2$ [J], which is three times that of the present embodiment.

As described above, in the liquid drop ejecting device relating to the second embodiment of the present invention, at the time of charging the piezoelectric element 40, the driving voltage of the piezoelectric element 40 is not controlled all at once from ground level to high level HV1, but is controlled from ground level through predetermined levels HV3, HV2 to high level HV1. Therefore, the liquid drop ejecting device can make the amount of heat generated due to the charging of the piezoelectric element 40 be ⅓ of that of the conventional art. Further, by controlling the voltage similarly at the time of discharging the piezoelectric element 40 as well, the liquid drop ejecting device can make the amount of heat generated due to the discharging of the piezoelectric element 40 be ⅓.

As has been described in relation to the above embodiments, in the first aspect and the second aspect of the present invention, because the capacitive load has electrostatic capacity, an RC circuit is structured when the capacitive load and a resistor within a circuit are connected. At this time, when the capacitive load is charged all at once or discharged all at once, a large amount of Joule heat is generated.

Thus, in the above-described aspects, a driving voltage waveform is generated in which a potential difference of the capacitive load varies stepwise from a first potential difference to a second potential difference during a predetermined time period, i.e., a time period which is based on a time constant determined by the driving circuit. Note that the first potential difference may be greater than, or may be smaller than, the second potential difference. In this way, the generated amount of heat is suppressed, and the capacitive load can be driven more efficiently.

In the third aspect of the present invention, liquid drops can be ejected efficiently while suppressing the amount of heat generated at the time of driving a capacitive load.

As described above, the capacitive load driving circuit and method and liquid drop ejecting device relating to the present invention can drive a capacitive load efficiently while suppressing the amount of heat which is generated at the time of driving the capacitive load.

Further, the present invention is not limited to the above-described embodiments, and the capacitive load driving circuit and method and liquid drop ejecting device relating to the present invention can drive a capacitive load efficiently while suppressing the amount of heat which is generated at the time of driving the capacitive load. The present invention is of course also applicable to structures whose designs have been modified within the scope of the claims.

For example, in the above embodiments, description is given of cases in which there are one or two intermediate level voltages. However, there may be three or more intermediate level voltages. In this case, even if the number of intermediate level voltages is increased, it suffices to make the transient periods at times of charging and at times of discharging not vary. Further, the above embodiments describe cases in which the values between the voltages which vary stepwise are equal, but the present invention is of course not limited to the same. Namely, although it is not necessary for the potential difference between terminals of the piezoelectric element 40 to be divided equally, efficiency is best when the potential difference is divided equally.

Further, in the first and second embodiments, cases in which one end of the piezoelectric element 40 is grounded are described as examples. However, it is fine for one end of the piezoelectric element 40 not to be grounded. For example, one end may be made to be a constant potential of +5 V, and the other end may be varied stepwise in a range of from +5 V to +30 V. Or, one end may be made to be a constant potential of −15 V, and the other end may be varied stepwise within a range of from −15 V to +15 V.

Moreover, one end of the piezoelectric element 40 does not necessarily have to be a constant potential. For example, the one end may be made to vary within a range of from 0 V to −15 V, and the other end made to vary within a range of from 0 V to +15 V.

What is claimed is:

1. A capacitive load driving circuit supplying driving voltage to a capacitive load, the circuit comprising:

a driving voltage waveform generating unit which, at times of charging or discharging of the capacitive load, generates a driving voltage waveform in which potential applied to the capacitive load varies stepwise from a first potential to a second potential during a predetermined time period;

wherein the driving voltage waveform generating unit has a plurality of power sources providing a plurality of potentials from the first potential to the second potential, and a plurality of switching elements switching supply to the capacitive load of the potentials provided by the plurality of power sources, the plurality of switching elements carrying out switching operation such that the potential applied to the capacitive load varies stepwise from the first potential to the second potential, wherein one end of the capacitive load is connected to a reference potential and the other end of the capacitive load is connected to the plurality of power sources providing different potentials respectively via the plurality of switching elements, and wherein the plurality of power sources includes a first power source that provides the first potential with respect to the reference potential, a second power source that provides the second potential with respect to the reference potential, and at least a third power source that provides an intermediate potential between the first potential and the second potential with respect to the reference potential, and the plurality of power sources are constant power sources that provide constant potentials, wherein a driving voltage waveform in which potential applied to the capacitive load varies stepwise at least three steps during charging and during discharging, and the differences in potentials for each adjacent steps are even.

2. The capacitive load driving circuit of claim 1, wherein the driving voltage waveform includes a portion which varies continuously on the basis of a time constant which is determined by the capacitive load and at least one portion of a driving circuit.

3. The capacitive load driving circuit of claim 1, wherein the predetermined time period is a time period which is set on the basis of a time constant which is determined by the capacitive load and at least one portion of a driving circuit.

4. The capacitive load driving circuit of claim 1, wherein the capacitive load includes a piezoelectric element.

5. The capacitive load driving circuit of claim 1, wherein a plurality of power sources are provided as the third power source.

6. The capacitive load driving circuit of claim 1, wherein the plurality of switching elements include first and second PMOS transistors and an NMOS transistor, the source of the NMOS transistor is connected to the reference potential, the source of the first PMOS transistor is connected to the second power source, the source of the second PMOS transistor is connected to the third power source, and the drains of the first and second PMOS transistors are both connected to the drain of the NMOS transistor and said other end of the capacitive load.

7. A liquid drop ejecting device comprising:

a liquid drop ejecting head having a nozzle, a pressure generating chamber in which liquid drops to be ejected from the nozzle are filled, and a capacitive load provided in correspondence with the pressure generating chamber, the liquid drop ejecting head ejecting a liquid drop from the nozzle by applying voltage corresponding to a driving signal to the capacitive load and changing a volume of the pressure generating chamber; and a capacitive load driving circuit supplying driving voltage to the capacitive load, and having a driving voltage waveform generating unit which, at times of charging or discharging of the capacitive load, generates a driving voltage waveform in which potential applied to the capacitive load varies stepwise from a first potential to a second potential during a predetermined time period;

wherein the driving voltage waveform generating unit has a plurality of power sources supplying a plurality of potentials from the first potential to the second potential, and a plurality of switching elements switching supply to the capacitive load of the potentials supplied by the plurality of power sources, the plurality of switching elements carrying out switching operation such that the potential applied to the capacitive load varies stepwise from the first potential to the second potential, wherein one end of the capacitive load is connected to a reference potential and the other end of the capacitive load is connected to the plurality of power sources providing different potentials respectively via the plurality of switching elements, and wherein the plurality of power sources includes a first power source that provides the first potential with respect to the reference potential, a second power source that provides the second potential with respect to the reference potential, and at least a third power source that provides an intermediate potential between the first potential and the second potential with respect to the reference potential, and the plurality of power sources are constant power sources that provide constant potentials, wherein a driving voltage waveform in which potential applied to the capacitive load varies stepwise at least three steps during charging and during discharging, and the differences in potentials for each adjacent steps are even.

8. The liquid drop ejecting device of claim 7, wherein the driving voltage waveform includes a portion which varies continuously on the basis of a time constant which is determined by the capacitive load and at least one portion of a driving circuit.

9. The liquid drop ejecting device of claim 7, wherein the predetermined time period is a time period which is set on the basis of a time constant which is determined by the capacitive load and at least one portion of a driving circuit.

10. The liquid drop ejecting device of claim 7, wherein the capacitive load includes a piezoelectric element.

11. The liquid drop ejecting device of claim 7, wherein a plurality of power sources are provided as the third power source.

12. The liquid drop ejecting device of claim 7, wherein the plurality of switching elements include first and second PMOS transistors and an NMOS transistor, the source of the NMOS transistor is connected to the reference potential, the source of the first PMOS transistor is connected to the second power source, the source of the second PMOS transistor is connected to the third power source, and the drains of the first and second PMOS transistors are both connected to the drain of the NMOS transistor and said other end of the capacitive load.

* * * * *